United States Patent [19]

Feigl

[11] Patent Number: 4,488,769

[45] Date of Patent: Dec. 18, 1984

[54] MODULAR PLUG

[75] Inventor: Werner Feigl, Diedorf, Fed. Rep. of Germany

[73] Assignee: Siemens Aktiengesellschaft, Berlin and Munich, Fed. Rep. of Germany

[21] Appl. No.: 483,880

[22] Filed: Apr. 11, 1983

[30] Foreign Application Priority Data

Apr. 30, 1982 [DE] Fed. Rep. of Germany ..... 3216217

[51] Int. Cl.[3] ..... H01R 13/58

[52] U.S. Cl. ..... 339/103 M; 339/107

[58] Field of Search ..... 339/103 R, 103 M, 104, 339/107

[56] References Cited

U.S. PATENT DOCUMENTS

| | | | |
|---|---|---|---|
| 3,412,367 | 11/1968 | Churla | 339/107 X |
| 4,005,921 | 2/1977 | Hadden et al. | 339/103 R X |
| 4,125,312 | 11/1978 | Aimar | 339/107 |
| 4,244,638 | 1/1981 | Little et al. | 339/103 M |

FOREIGN PATENT DOCUMENTS

| | | | |
|---|---|---|---|
| 2228780 | 1/1974 | Fed. Rep. of Germany | 339/103 M |

*Primary Examiner*—Joseph H. McGlynn

*Assistant Examiner*—Steven C. Bishop

*Attorney, Agent, or Firm*—Hill, Van Santen, Steadman & Simpson

[57] ABSTRACT

A modular plug has at least two rows of contact chambers lying next to one another in which spring contacts are located. The spring contacts are connected at one end to the conductors of a cable. The first and last spring chambers of each row are designed as empty chambers into which catch hooks can be introduced. These empty chambers are employed to accept strain relief inserts which are designed as L-shaped structures in which an elongate member of the L-shaped strain relief insert terminates in a catch hook to bear against the forward face of the plug and the cross member of the insert is designed as a tab which has passages therethrough which lie opposite similar passages of a second strain relief insert upon engagement of the elongate members in the empty chambers. The cable can thereby be introduced between the cross members and secured by the cable strap which extends through the passages. The material of the cross members outboard of the passages is designed with a break rating so that sections of the cross members may be broken off to reduce the lengths of the cross member.

2 Claims, 2 Drawing Figures

MODULAR PLUG

BACKGROUND OF THE INVENTION

1. Field of the Invention

The present invention relates to electrical connectors, and more particularly to a modular plug having at least two rows of contact chambers extending adjacent to one another in which spring contacts are located, the spring contacts being connected at one end to leads of a cable, whereby the first and last spring chambers of a row are designed as empty chambers for two respective catch hooks to be introduced therein and positioned diagonally opposite one another across the plug.

2. Description of the Prior Art

Modular plugs which comprise at least two rows of contact chambers in which spring contacts are located are well known in the art. Empty chambers to which catch hooks can be introduced for lock-in are thereby provided at the beginning and at the end of the rows of the contact springs for lock-in into cooperating plug parts. It is thereby sufficient for lock-in when such catch hooks are provided in the two empty chambers respectively lying diagonally opposite one another. The free chamber lying next to the respective catch hook is therefore not used.

SUMMARY OF THE INVENTION

Given modular plug connectors of the type generally set forth above, the object of the present invention is to provide a simple strain relief.

The above object is achieved, according to the present invention, by providing strain relief inserts which can be inserted into the other two empty chambers which are not provided with catch hooks and which lie diagonally opposite one another, the strain relief inserts being designed L-shaped, whereby the longitudinal beam of the L-shaped strain relief inserts terminates in a catch hook, whereas the cross pieces of the L-shaped strain relief inserts are designed as tabs provided with passages in a prescribed spacing which, when the elongate portions are engaged in the free empty chambers, lie coincidingly opposite one another and in that the approaching cable can be introduced between the two tabs and can be secured therebetween by a cable strap which passes through the passages of the tabs.

With the above structure, a strain relief is provided which can be matched to the respective use in a simple manner for the aforementioned type of modular plug connector.

When the tabs are provided with a plurality of passages lying next to one another which are at the same time designed as rated break locations for shortening of the tabs, which may become necessary, then the strain relief inserts can be systematically matched to the respective plug size in that the tabs are broken off at the respective required location.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
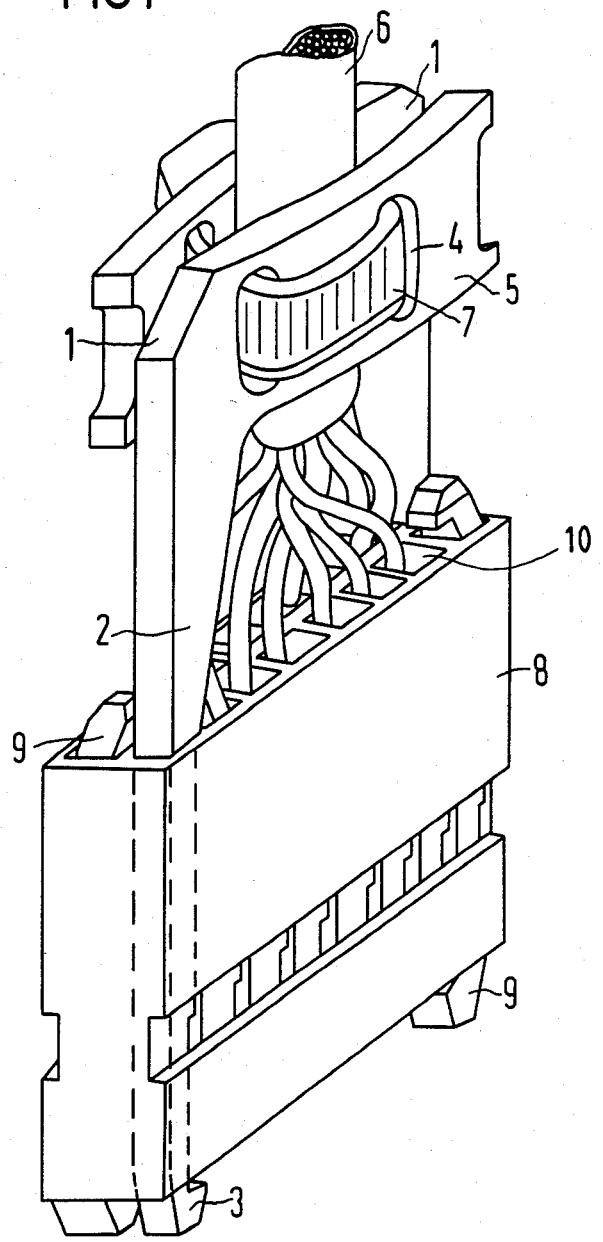
FIG. 1 is a perspective view of a complete modular plug housing having a strain relief constructed in accordance with the present invention.

The modular plug connector housing 8 comprises, for example, a plurality of rows of chambers 10 disposed next to one another into which spring contacts (not shown) are inserted. At one end, the spring contacts are connected to the leads of a cable 6, whereas they can be introduced into cooperating contact chambers and into engagement with contacts therein (not illustrated) of the mating connector. Empty chambers into which catch hooks 9 can be inserted are provided at the beginning and end of each row for locking such plug-type connectors. It is sufficient for such catch hooks to be inserted into the two catch chambers lying diagonally opposite one another. The further empty chambers lying next to the catch hooks are then employed as fastening chambers for the strain relief inserts 1.

Figure 2:
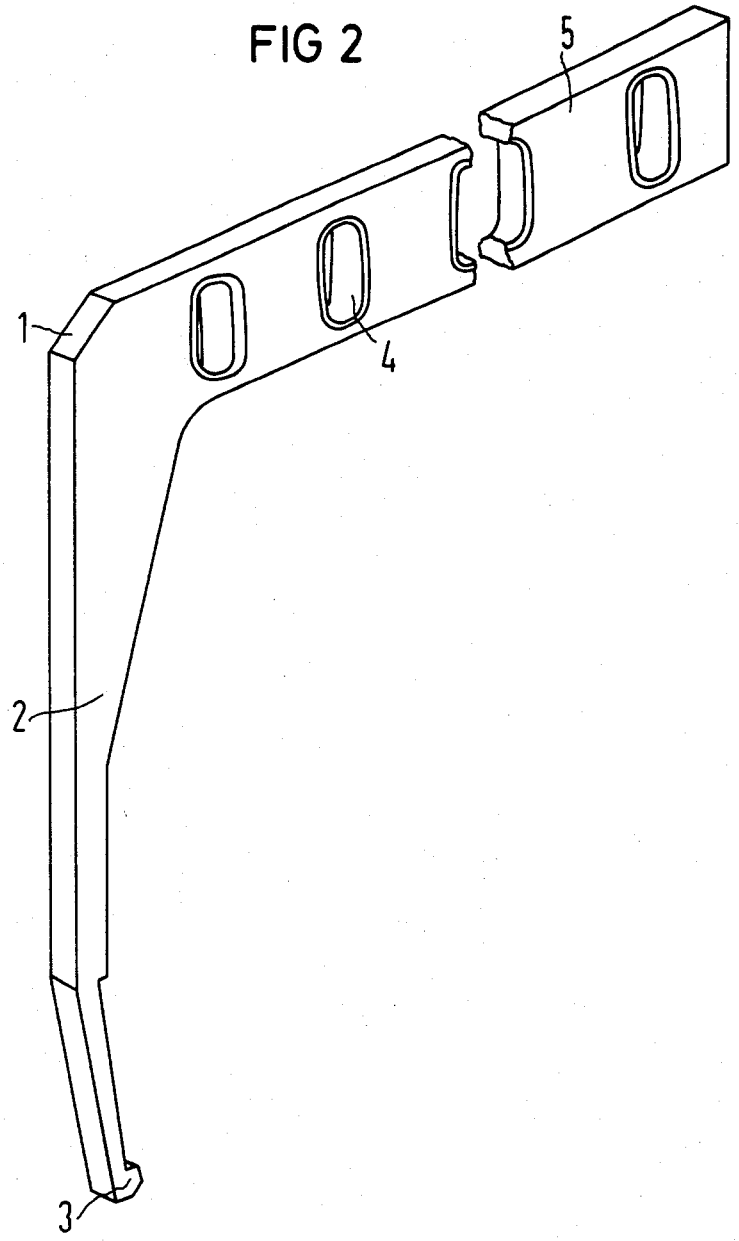
FIG. 2 is a perspective view of a strain relief insert contructed in accordance with the present invention.

The strain relief inserts 1, as best seen in FIG. 2, are designed L-shaped. The elongate leg 2 of the strain relief insert extends slightly toward the inside at its upper portion and terminates in a catch hook 3. The cross piece of the L-shaped strain relief insert 1 is designed as a tab which is provided with a plurality of passages 4 spaced apart across the cross piece at specific intervals. These passages 4 also provide rated break locations for the tabs 5 so that individual matching to the respective use is possible.

Extending toward and generally parallel to one another, two such strain relief inserts are inserted into two empty chambers of the modular plug 8 which are diagonally opposite to one another so that their elongate portions and the catch hook 3 engage the housing. The cable 6 introduced into the modular plug 8 can then be clamped between the two tabs 5 and can be secured with the assistance of a cable strap 7.

A simple strain relief is thereby achieved whereby the strain relief inserts can be selectively plugged in.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. For use with a modular plug of the type which has a forward surface and parallel rows of contact chambers extending rearwardly of said forward surface with contacts in at least some of the chambers as necessary except for diagonally opposite chambers of two separate rows, and which has a plurality of conductors of a cabie connected to respective contacts, a strain relief for the cable comprising:

a pair of L-shaped inserts each including an elongate member and a cross member, each of said elongate members including a hook at its distal end and sized to be received through an empty contact chamber so that said hook engages against said forward surface to latch and prevents rearward movement of said insert, and means defining spaced apertures through said cross member of each of said inserts so that when both inserts are latched in the respective empty contact chambers with the cross members extending in mutually opposite directions some of said apertures of both inserts are generally opposite one another on opposite sides of the cable; and a cable strap for extending through the opposed apertures to secure the cable.

2. The strain relief of claim 1, wherein:

said means defining said apertures include reduced rated break locations so that said cross members may be selectively shortened by breaking.

* * * * *